United States Patent [19]

Honda et al.

[11] Patent Number: 5,076,854

[45] Date of Patent: Dec. 31, 1991

[54] MULTI-FREQUENCY ULTRASONIC CLEANING METHOD AND APPARATUS

[75] Inventors: Keisuke Honda, Aich; Hideo Kosaka, Toyohashi; Toshiaki Miyamoto, Aichi, all of Japan

[73] Assignee: Honda Electronics Co., Ltd., Aichi, Japan

[21] Appl. No.: 436,063

[22] Filed: Nov. 13, 1989

[30] Foreign Application Priority Data

Nov. 22, 1988 [JP] Japan ..... 63-295514

[51] Int. Cl.[5] ..... B08B 7/00

[52] U.S. Cl. ..... 134/1; 134/25.1; 134/25.4; 134/184; 346/1.1

[58] Field of Search ..... 134/1, 25.1, 25.4, 18; 346/1.1

[56] References Cited

U.S. PATENT DOCUMENTS

| | | | |
|---|---|---|---|
| 3,651,352 | 3/1972 | Puskas | 134/1 |
| 3,928,063 | 12/1975 | King, Jr. et al. | 134/1 |
| 4,120,699 | 10/1978 | Kennedy, Jr. et al. | 134/1 |
| 4,391,672 | 7/1983 | Lehtinen | 134/1 |
| 4,563,688 | 1/1986 | Braun | 346/1.1 |
| 4,595,419 | 6/1986 | Patenarde | 134/1 |
| 4,826,538 | 5/1989 | Sanders et al. | 134/25.1 |

*Primary Examiner*—Asok Pal

*Attorney, Agent, or Firm*—Burgess, Ryan & Wayne

[57] ABSTRACT

When output signals of different multi-frequencies are supplied to one vibrator every short time interval, ultrasonic waves generating from the vibrator having continuing frequencies in which frequencies between separated resonance frequencies are supplemented. Therefore, the cleaning effect is improved by the ultrasonic waves.

4 Claims, 3 Drawing Sheets

MULTI-FREQUENCY ULTRASONIC CLEANING METHOD AND APPARATUS

BACKGROUND OF THE INVENTION

The present invention relates to a multi-frequency ultrasonic cleaning method and apparatus for improving a cleaning effect by emitting ultrasonic waves of multi-frequencies.

In the prior art, generally used cleaning apparatus (see FIG. 1), one vibrator 2 is attached at a bottom portion of a cleaning tank 1. When a signal of a resonance frequency of the vibrator 2 is applied from an oscillator 3 to the vibrator 2, an ultrasonic wave having the resonance frequency of the vibrator 2 is emitted from the vibrator 2 and the surface to be cleaned in the cleaning tank 1 are cleaned by the ultrasonic wave.

Because it is not easy to remove stain from the surface to be cleaned by using an ultrasonic wave of one frequency, a plurality of vibrators generating ultrasonic waves of different resonance frequencies are attached to the tank 1 and the stain which is not removed from the surface to be cleaned in the ultrasonic wave of the one frequency is removed by ultrasonic waves of different resonance frequencies.

In such cleaning apparatus, because a plurality of vibrators are attached to the cleaning tank 1, the cleaning tank 1 must be made adequately large, and since only the ultrasonic waves of the resonance frequencies of the respective vibrators are generated, a stain which is removed only by an ultrasonic wave of other frequencies except these frequencies is not removed by the above frequencies.

For supplying ultrasonic waves of multi-frequencies from one vibrator the applicant provided an asymmetric Langevin type vibrator 4 in which piezoelectric vibrators 5 and electrodes 5*a* and 5*b* are put between a long metal block 6 and a short metal block 7 and screw threads at both ends of a bolt not shown are engaged with screw threads of the metal blocks 6 and 7 (see FIGS. 2 and 3).

Three oscillators of different frequencies are connected through a switching circuit to the electrodes 5*a* and 5*b* of the vibrator 4 and this vibrator 4 can emit three ultrasonic waves of three frequencies every predetermined time intervals respectively.

Because the one vibrator 4 transmits ultrasonic waves of three different frequencies, the cleaning tank 1 can be formed small. However, only the three ultrasonic waves are transmitted from the vibrator 4, thus, the same as the prior art, so that stain removed by other frequencies are not removed by the three frequencies.

SUMMARY OF THE INVENTION

It is, therefore, the primary object of the present invention to provide a multi-frequency ultrasonic cleaning method and apparatus in which the cleaning effect is improved.

It is and other object of the present invention to provide a multi-frequency ultrasonic cleaning method and apparatus in which signals of multi-frequencies are supplied to one vibrator by switching every predetermined short time interval, and thus, the cleaning effect is improved.

In order to accomplish the above and other objects, the present invention provides a multi-frequency ultrasonic cleaning method in which signals of two or more frequencies are supplied to one vibrator by switching frequencies every predetermined short time interval, and ultrasonic waves of the two or more frequencies and other frequencies from the vibrator are supplied to the cleaning liquid.

Also, the present invention provides a multi-frequency ultrasonic cleaning apparatus comprising one vibrator, a drive circuit connected to the vibrator, a fast switching circuit connected to the drive circuit, two or more oscillators connected to the switching circuit, the fast switching circuit switching the signals from the oscillators every predetermined short time, interval and a control circuit for controlling the switching circuit.

Figure 4:
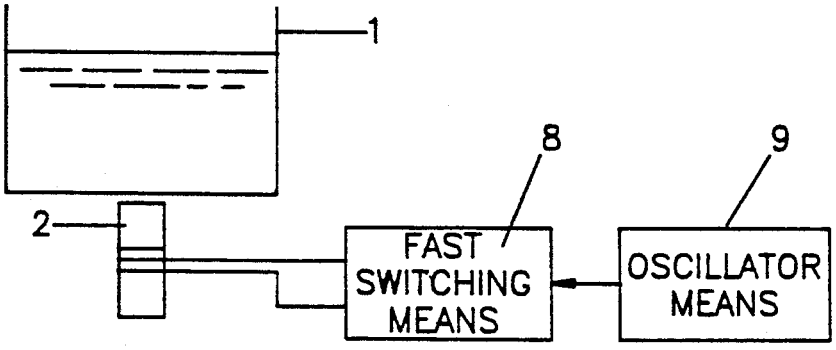
FIG. 4 shows a view for explaining the method according to the present invention.

DESCRIPTION OF THE PREFERRED EMBODIMENTS:

Referring to FIG. 4, in the present invention, a vibrator 2 is attached to a tank 1 and is connected through a fast switching means 8 to an oscillator means 9.

In such constitution of the present invention, when signals of different frequencies from the oscillator means 9 are fast switched with the fast switching means 8 and are supplied to the vibrator 2, ultrasonic waves of the frequencies from the oscillator means 9 and frequencies continued between the frequencies from the oscillator means 9 are emitted from the vibrator 2. Therefore, a stain which is not removed by the ultrasonic waves of the frequencies from the oscillator means 9 is effectively removed from a surface because the range of the frequency is spread and the cleaning effect is improved.

This principle is that the ultrasonic wave emitted from the vibrator 2 has continuing frequencies by generating ultrasonic waves to supplement frequencies between the separated resonance frequencies from the oscillator 9. That is, the vibrator per se generates a continuing spectrum as a transient phenomena of the vibrator due to the fast switching of the input signals. Further because previous vibrations remain in the liquid when the frequencies are switched, cavitation (bubbles) is easily generated by the remaining vibrations and the continuing spectrum generated when the cavitation is broken. The cleaning effect is improved by these ultrasonic waves.

Figure 5:
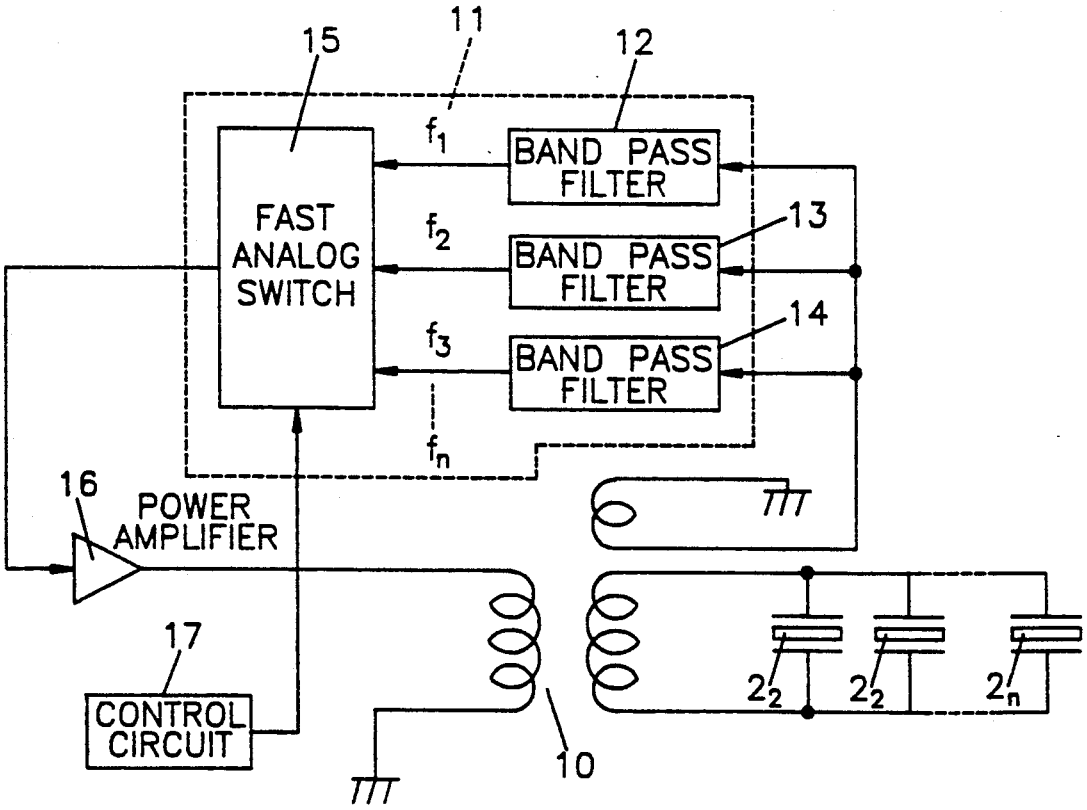
FIG. 5 shows a circuit of an embodiment according to the present invention.

Referring to FIG. 5, in the present invention, the vibrator is connected to a secondary winding of a transformer 10, a separated secondary winding of the transformer 10 is connected to first, second and third band pass filter 12, 13 and 14 having center frequencies $f_1$, $f_2$ and $f_3$ in a feedback circuit 11 and the first, second and third band pass filters 12, 13 and 14 are connected to a fast analog switch 15. The output terminal of the fast analog switch 15 is connected to a power amplifier 16, the output terminal of the power amplifier 16 is connected to one end of a first winding of the transformer 10 and the other end of the first winding is connected to ground. Also, the analog switch 15 is controlled in time by a control circuit 17.

In the present embodiment, because the feedback circuit 11 is positive feedback, this circuit is oscillated by any signal, and the signals of the frequencies $f_1$, $f_2$ and $f_3$ are transmitted through the band pass filters 12, 13 and 14 from the separated winding of the transformer 10 to the fast analog switch 15. When the signals of the frequencies $f_1$, $f_2$ and $f_3$ are switched by the fast analog switch 15 every short time interval to which the control signals from the control circuit 17 are supplied, these short signals are amplified in the power amplifier 16 and are transmitted to the vibrator through the transformer 10, whereby, the ultrasonic waves having so continued frequencies such that frequencies between the frequencies $f_1$, $f_2$ and $f_3$ and supplemented are emitted from the vibrator 2. Therefore, a stain which are not removed by the ultrasonic wave of the frequencies $f_1$, $f_2$ and $f_3$ is removed by the ultrasonic waves from the vibrator 2 in the present invention.

Figure 6:
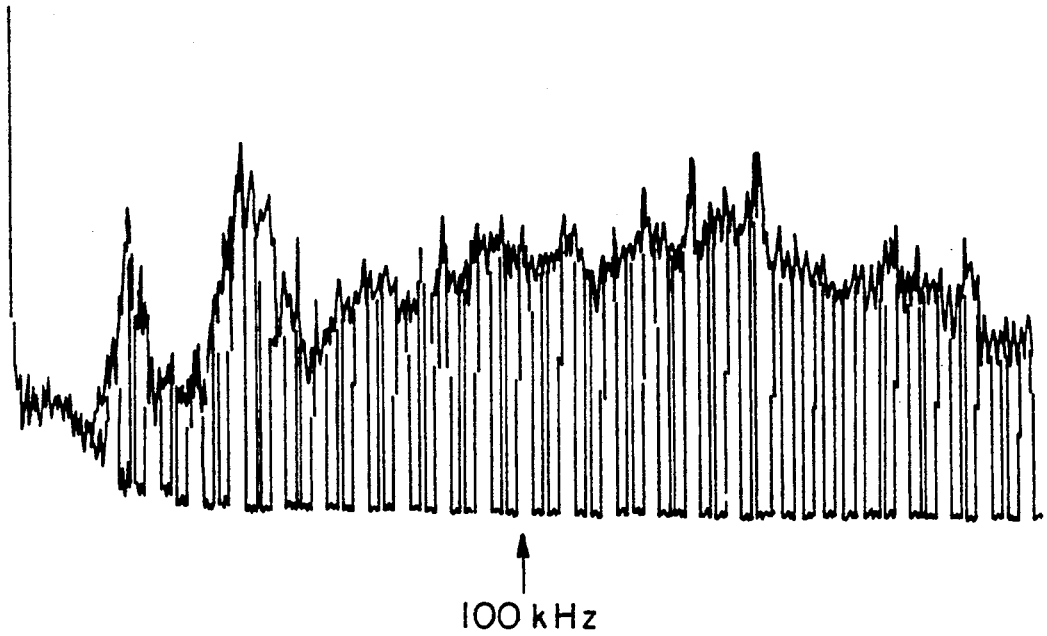
FIG. 6 shows a wave form of respective frequencies of and ultrasonic wave spectrum generated from the vibrator which are detected every short time interval (1 milli-second).

FIG. 6 shows a wave form of and ultrasonic wave spectrum switched every short time interval and detected in the tank, in which the frequency $f_1$ is 18 KHz, the frequency $f_2$ is 45 KHz and the frequency $f_3$ is 100 KHz.

As understood in this drawing, in the ultrasonic waves emitted from the vibrator 2, because the frequency is continued from 0 to 200 KHz, cleaning according to the above ultrasonic wave is effectively improved.

Figure 7:
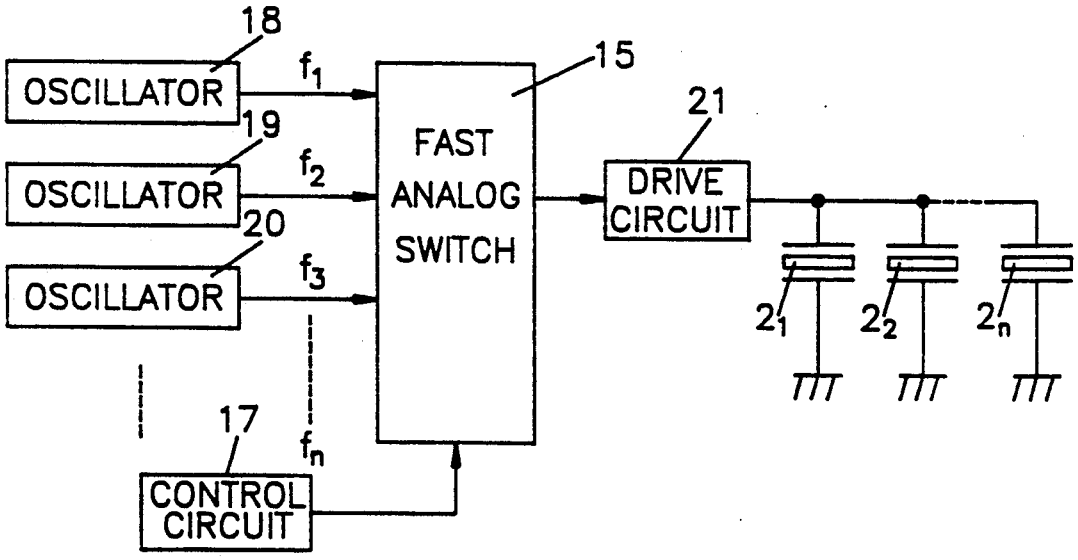
FIG. 7 shows a circuit of the other embodiment according to the present invention.

Referring to FIG. 7, in other embodiment according to the present invention, the oscillators 18, 19, 20, . . . are connected to the analog switch 15 and the analog switch 15 is controlled as to the switching times by the control circuit 17. The frequencies $f_1$, $f_2$ and $f_3$ are selected as the resonance frequencies of the vibrator 2. The output signals of the analog switch 15 are amplified by the drive circuit 21 and are supplied to vibrator 2.

In the embodiment according to the present invention, because the signals of the frequencies $f_1$, $f_2$ and $f_3$ are switched by the analog switch 15 every short time, interval the signals having frequency components between the frequency $f_1$ and the frequency $f_3$ are emitted from the vibrator 2, and thus, the cleaning effect is effectively improved.

Figure 1:
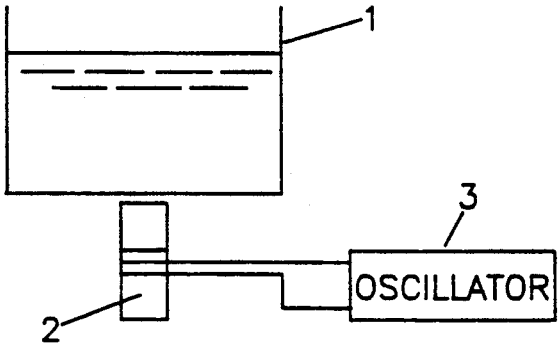
FIG. 1 PRIOR ART
FIG. 1 shows a schematic view of a prior cleaning apparatus.
Figure 2:
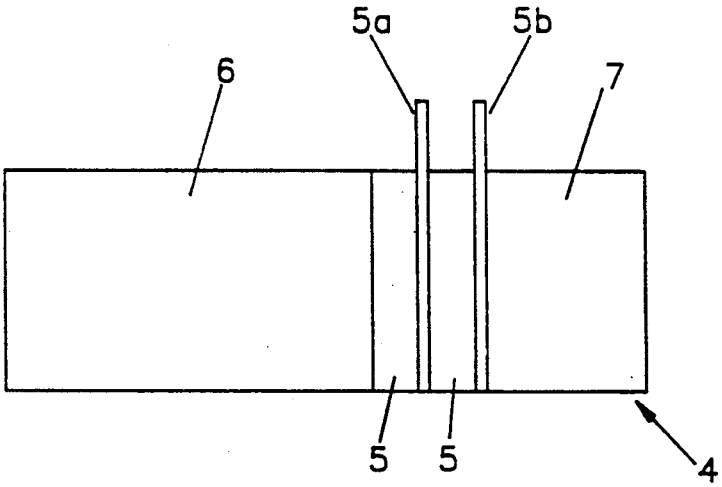
FIGS. 2 and 3 show side views of vibrators provided by the applicant.
Figure 3:
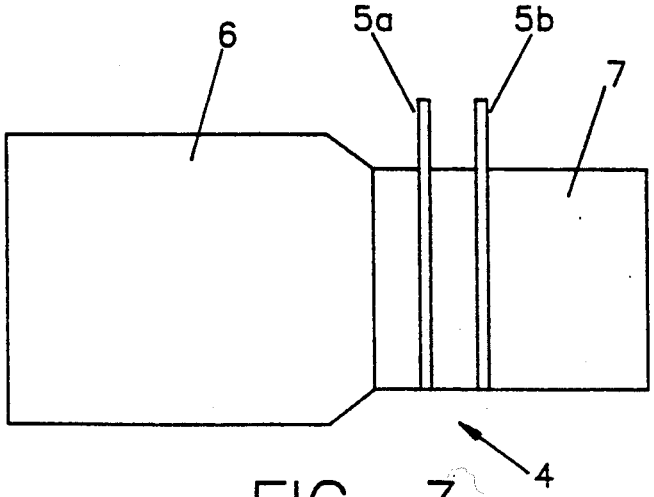

In the above embodiments, the instance which uses a usual Langevin type vibrator as a vibrator 2 is shown. However, the same effect is obtained by using a vibrator generating ultrasonic waves of the multi-frequencies as shown in FIG. 2. Also, the same effect is obtained by using a vibrator generating ultrasonic waves of the multi-frequencies as shown in FIG. 3.

In the present invention, because the ultrasonic waves of the frequencies of the wide range more than the resonance frequencies of the vibrator 2 are transmitted, the stain which is not removed by the respective resonance frequencies is effectively removed by the ultrasonic waves of the continuing frequencies between the frequencies $f_1$ and $f_3$ or more and the cleaning effect is improved.

What is claimed is:

1. A multi-frequency ultrasonic method for cleaning a surface comprising outputting signals having two or more different frequencies switched every 0.01 to 20 milliseconds and which are supplied to a vibrator, and the ultrasonic waves of continuing frequencies comprising said two or more frequencies and other frequencies which are emitted from the vibrator, whereby the surface to be cleaned is effectively cleaned by the ultrasonic waves.

2. A multi-frequency ultrasonic cleaning method as set forth claim 1 wherein the vibrator has a plurality of resonance frequencies.

3. A multi-frequency ultrasonic cleaning apparatus comprising one vibrator, a drive circuit connected to the vibrator, a fast switching circuit connected to the drive circuit, at least two oscillators connected to the fast switching circuit, the fast switching circuit switching the signals from the oscillators every 0.01 to 20 milliseconds, and a control circuit for controlling the switching circuit.

4. A multi-frequency ultrasonic cleaning apparatus as set forth claim 3 wherein the vibrator has a plurality of resonance frequencies.

* * * * *